US007357076B2

(12) United States Patent
Sato

(10) Patent No.: US 7,357,076 B2
(45) Date of Patent: Apr. 15, 2008

(54) IMAGE FORMING APPARATUS

(75) Inventor: Mitsuo Sato, Miyagi (JP)

(73) Assignee: Tohoku Ricoh Co., Ltd., Shibata-gun (JP)

( * ) Notice: Subject to any disclaimer, the term of this patent is extended or adjusted under 35 U.S.C. 154(b) by 277 days.

(21) Appl. No.: 11/048,170

(22) Filed: Feb. 2, 2005

(65) Prior Publication Data

US 2005/0217520 A1 Oct. 6, 2005

(30) Foreign Application Priority Data

Mar. 30, 2004 (JP) ..... 2004-099406

(51) Int. Cl.
*B05C 17/06* (2006.01)

(52) U.S. Cl. ..... 101/128; 101/127

(58) Field of Classification Search ..... None
See application file for complete search history.

(56) References Cited

U.S. PATENT DOCUMENTS 5,781,823 A * 7/1998 Isobe et al. ..... 399/2
6,502,506 B2 * 1/2003 Endo et al. ..... 101/118
6,539,854 B2 * 4/2003 Maeda et al. ..... 101/118
6,711,998 B2 * 3/2004 Hashimoto ..... 101/129
6,725,770 B2 * 4/2004 Maeda ..... 101/129
7,050,725 B2 * 5/2006 Jingu ..... 399/2

FOREIGN PATENT DOCUMENTS

JP 9-104159 4/1997
JP 2001-347740 12/2001
JP 2002-127580 5/2002
JP 2003-334993 11/2003

* cited by examiner

*Primary Examiner*—Anthony H. Nguyen
(74) *Attorney, Agent, or Firm*—Oblon, Spivak, McClelland, Maier & Neustadt, P.C.

(57) ABSTRACT

An image forming apparatus of the present invention includes a stencil printer section and a non-stencil printer section and can form a stencil image and a non-stencil image on a single sheet. A first and a second adjusting section respectively adjusts the position of the stencil image and that of the non-stencil image relative to the sheet in the direction of sheet conveyance and the widthwise direction of the sheet perpendicular to the direction of sheet conveyance. A first shift display section displays an amount of shift of the position adjusted by the first adjusting section. A first moving mechanism shifts the position of the stencil image in accordance with the operation of the first adjusting section. A second shift display section displays an amount of shift of the position adjusted by the second adjusting section. A second moving mechanism shifts the position of the non-stencil image in accordance with the operation of the second adjusting section.

14 Claims, 8 Drawing Sheets

IMAGE FORMING APPARATUS

BACKGROUND OF THE INVENTION

1. Field of the Invention

The present invention relates to an image forming apparatus and more particularly to an image forming apparatus capable of performing both a stencil printer type of image formation and a non-stencil printer type of image formation.

2. Description of the Background Art

A digital, thermosensitive stencil printer of the type using a print drum implemented as a porous, hollow cylinder and a stencil is conventional. In this type of printer, a thermal head selectively perforates or cuts the stencil, which is implemented as a laminate of a thermoplastic resin film and a porous support, with heat in accordance with image data to thereby produce a master. After the master has been wrapped around the print drum, ink feeding means arranged inside the print drum feeds an adequate amount of ink to the inner periphery of the print drum. Subsequently, a press roller, press drum or similar pressing member presses a sheet against the print drum via the master. As a result, the ink is transferred to the sheet via the porous portion of the print drum and master. A stencil printer with such a configuration is used mainly to produce as many as several ten or more prints carrying identical image thereon because it reduces cost for a single print and can operate at high speed, i.e., output a great number of prints in a short period of time.

However, a stencil printer, needing a master at the time of printing, is not desirable when only a small number of prints, e.g., one to several prints are desired or when a particular partial image should be printed over each of several ten identical images. Further, when it is desired to print images corresponding to a plurality of different documents with a stencil printer and staple or otherwise bind the resulting prints, collation must be effected after printing. Therefore, a stencil printer is unable to function as, e.g., a copier capable of repeatedly outputting different document images in order of page.

More specifically, a stencil printer or stencil type of image forming apparatus is desirable when a single image should be printed on a great number of sheets. On the other hand, an electrophotographic printer, ink jet printer or similar non-stencil type of image forming apparatus is desirable when different images should be formed on a small number of sheets. While a user, considering such merits and demerits of the two different types of image forming apparatuses, is required to selectively use the apparatuses in accordance with the kind of image formation, the two types of apparatuses would double the cost and space required when installed at the user's station together. Usually, therefore, a user is obliged to own only one of the two types of image forming apparatuses to be used more often than the other.

To solve the problem stated above, Japanese Patent Laid-Open Publication No. 2003-334993, for example, discloses an image forming apparatus including both of a stencil printer section and an ink jet printer or non-stencil printer section and means for moving the ink jet printer section in the widthwise direction of a sheet, which is perpendicular to the direction of sheet conveyance, in accordance with the sheet size. More specifically, the stencil printer section forms an image by using the center of a sheet as a reference while the ink jet printer section forms it by using one edge of a sheet as a reference. In light of this, the means for moving the ink jet printer section mentioned above serves to accurately match the position of an image formed by the stencil printer section (stencil image hereinafter) and that of an image formed by the ink jet printer section (ink jet image or non-stencil image hereinafter) in accordance with the sheet size.

However, Laid-Open Publication No. 2003-334993 mentioned above does not teach any arrangement for shifting the position of the stencil image or that of the ink jet image in the direction of sheet feed or the widthwise direction of a sheet. More specifically, a stencil printer usually includes mechanisms and an operating section for shifting the position of a stencil image relative to a sheet in the direction of sheet conveyance and the widthwise direction of a sheet. By contrast, in the case of an ink jet printer, the position of an ink jet image cannot be shifted relative to a sheet unless it is shifted on a personal computer, which stores image data, by troublesome operation. This indicates that the image forming apparatus taught in the above document is extremely awkward to operate.

Further, it is a common practice to form a plurality of identical images on a single sheet side by side and then cut the sheet to thereby efficiently produce, e.g., a plurality of tickets or cards. In such a case, the image forming apparatus disclosed in Laid-Open Publication No. 2003-334993 is capable of forming identical images by stencil printing and then forming, e.g., addresses or serial numbers in part of the identical images by ink jet printing or non-stencil printing. The prerequisite with this kind of image formation is not only to adequately match the position of the stencil image and that of the non-stencil image, but also to match the distance between nearby non-stencil images to the distance between nearby stencil images. It is extremely difficult to match the above distances with the technology taught in the above document.

Technologies relating to the present invention are also disclosed in, e.g., Japanese Patent Laid-Open Publication Nos. 9-104159, 2001-347740 and 2002-127580.

SUMMARY OF THE INVENTION

It is an object of the present invention to provide an image forming apparatus capable of easily matching the position of a stencil image and that of a non-stencil image and easily matching the distance between a plurality of non-stencil images.

An image forming apparatus of the present invention includes a stencil printer section using a stencil and a non-stencil printer section not using a stencil and is capable of forming a stencil image and a non-stencil image on a single sheet with the stencil printer section and non-stencil printer section, respectively. A first adjusting section adjusts the position of the stencil image relative to the sheet in the direction of sheet conveyance and the widthwise direction of the sheet, which is perpendicular to the direction of sheet conveyance. A first shift display section displays an amount of shift of the position adjusted by the first adjusting section. A first moving mechanism shifts the position of the stencil image in accordance with the operation of the first adjusting section. A second adjusting section adjusts the position of the non-stencil image relative to the sheet in the direction of sheet conveyance and the widthwise direction of the sheet. A second shift display section displays an amount of shift of the position adjusted by the second adjusting section. A second moving mechanism shifts the position of the non-stencil image in accordance with the operation of the second adjusting section.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
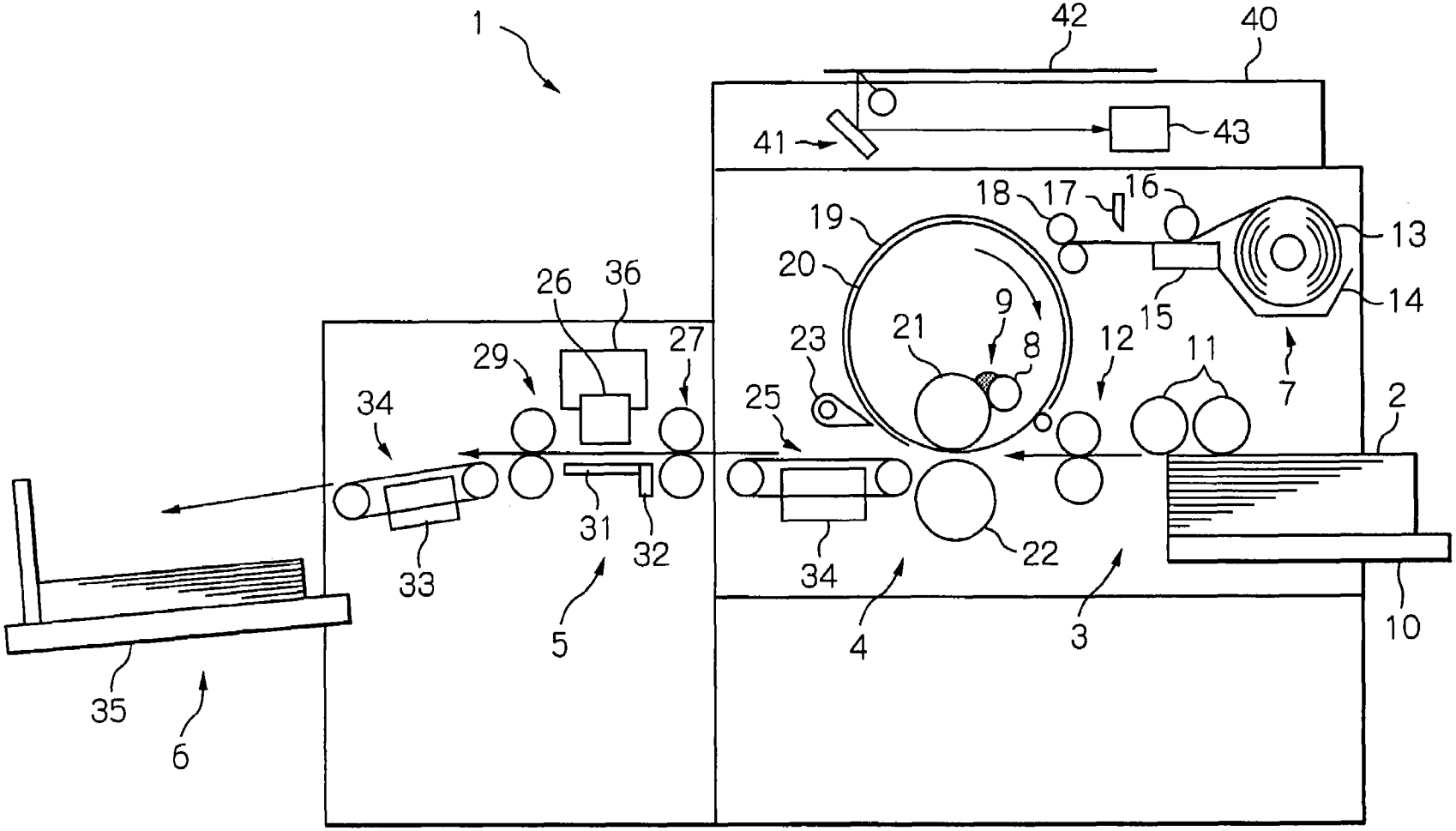
FIG. 1 is a front view showing an image forming apparatus embodying the present invention.

Referring to FIG. 1 of the drawings, an image forming apparatus embodying the present invention is shown and generally designated by the reference numeral 1. As shown, the image forming apparatus 1 includes a sheet feeding section 3 for feeding a stack of sheets 2 one by one. A stencil printer section or stencil printing section 4 prints a stencil image on the sheet 2 fed from the sheet feeding section 3 by using a master. An ink jet printer section or non-stencil printing section 5 prints an ink jet or non-stencil image on part of the sheet 2 carrying the stencil image formed by the stencil printer section 4. The sheet 2, carrying such images thereon, is driven out to a sheet stacking section 6.

More specifically, the sheet feeding section 3 includes a sheet tray 10 loaded with the sheets 2, a pickup roller pair 11 and a registration roller pair 12. The pickup roller pair 11 sequentially pays out the sheets 2 from the sheet tray 10 one by one, the top sheet being first. The registration roller pair 12 once stops the sheet 2 fed from the pickup roller pair 11 and then conveys it toward the stencil printer section 4 at preselected timing.

A master making section 7 is arranged at the upper right of the stencil printer section 4 and includes a stencil holder 14 storing a stencil 13, which is implemented as a roll. A thermal head 15 and a platen roller 16 are positioned downstream of the master holder 14 in a direction in which the stencil 13 is paid out from the roll. A cutter or cutting means 17 for cutting the stencil 13 is located downstream of the thermal head 15 and platen roller 16 in the above direction while a roller pair 18 for conveying the stencil 13 is located downstream of the cutter 17 in the same direction. The master making section 7 perforates, or cuts, the stencil 13 in accordance with image data and then conveys the stencil 13 toward the stencil printer section 4.

The stencil printer section 4 includes a print drum 20 around which the perforated stencil 13, i.e., a master 19 produced by the master making section 7 is wrapped. A press roller 22 is selectively movable into or out of contact with the circumference of the print drum 20. A peeler 23 peels off the sheet 2 from the circumference of the print drum 20. A belt conveyor 25 conveys the sheet 2 thus peeled off. At this instant, a suction fan 24 retains the sheet 2 on a belt included in the belt conveyor 25 by suction. Ink feeding means 9, including an ink roller 21 and a doctor roller 8, is arranged inside the print drum 20. When the press roller 22 presses the sheet 2 fed from the sheet feeding section 3 against the master 19, which is wrapped around the print drum 20, ink fed from the ink feeding means 9 is transferred to the sheet 2 to thereby form an image on the sheet 2. A master discharging section, not shown, is located at the upper left of the print drum 20 in order to peel off the used stencil 19 from the print drum 20 and discard it.

In the illustrative embodiment, the stencil printer section 4 further includes a moving mechanism or first moving mechanism, not shown, for shifting the position of a stencil image to be printed on the sheet 2, i.e., the position of the sheet 2 relative to an image formed in the master 19, which is wrapped round the print drum 20. The moving mechanism may be constructed in the same manner as, e.g., a moving mechanism 80 or 280 disclosed in Japanese Patent Laid-Open Publication No. 9-104159.

The ink jet printer section 5 includes a print head 26 positioned above a sheet conveyance path, roller pairs 27 and 29 respectively positioned upstream and downstream of the print head 26 in the direction of sheet conveyance, a guide plate 31 positioned below the sheet conveyance path for guiding the sheet 2, and a sheet sensor 32 for sensing the leading edge of the sheet 2 in the direction of sheet conveyance. The output of the sheet sensor 32 is used to set a reference for starting forming an ink jet image on the sheet 2. The roller pairs 27 and 29 convey the sheet 2 at a preselected ink jet print speed, which is equal to or higher than a speed at which the sheet 2 is driven out of the stencil printer section 4.

The upper rollers of the roller pairs 27 and 29 positioned above the sheet conveyance path directly contact the stencil image formed on the sheet 2. It is therefore preferable to provide the circumferential surfaces of the upper rollers with fine irregularities so as to protect them from smears ascribable to wet ink. For example, a film set with fine ceramic abrasive grains or fine glass beads may be adhered to the circumferential surface of each upper roller.

In the illustrative embodiment, the ink jet printer section 5 further includes a moving mechanism or second moving mechanism 36 for moving the line type print head 26 in the direction perpendicular to the direction of sheet conveyance, i.e., in the widthwise direction of the sheet 2.

Figure 2:
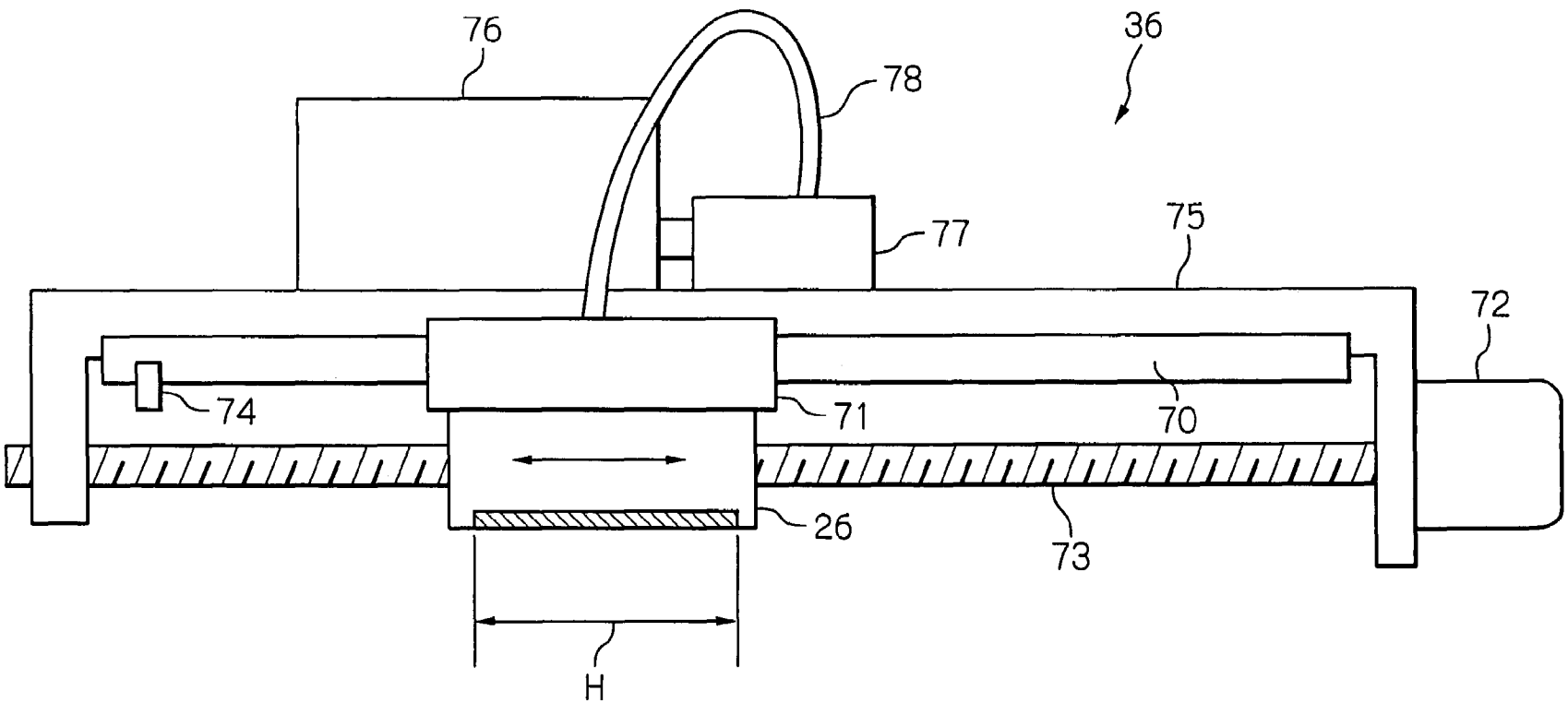
FIG. 2 is a view showing a second moving mechanism included in the illustrative embodiment.

More specifically, as shown in FIG. 2, the second moving mechanism 36 includes a guide rail 70 mounted on a frame 75. A carriage 71 is constructed integrally with the upper portion of the print head 26 and mounted on the guide rail 70 in such a manner as to be slidable in the widthwise direction of the sheet, i.e., in the right-and-left direction in FIG. 2. A lead screw 73 is held in threaded engagement with the print head 26. When a stepping motor 72 mounted on the frame 75 is driven to rotate the lead screw 73, the lead screw 73 causes the print head 26 to move in the widthwise direction of the sheet. A home position sensor 74 responsive to the home position of the print head 26 is mounted on the guide rail 70. The position of the print head 26 is determined on the basis of the output of the home position sensor 74 and the number of steps of the stepping motor 72. Also shown in FIG. 2 are a removable ink cartridge 76, an ink feed pump 77, and a tube 78 for delivering ink. The print head 26 is capable of forming an image over a length H as measured in the widthwise direction of the sheet.

The moving mechanism 36 with the above configuration is capable of controlling the position of an ink jet image or non-stencil image to be formed on the sheet 2 in the widthwise direction of the sheet 2. Further, the operation timing of the print head 26 is controllable to control the position of the ink jet image on the sheet 2 in the direction of sheet conveyance. The print head 26 operates in accordance with image data received from a personal computer 45, see FIG. 7, connected to the image forming apparatus 1 or a variable data memory 47, see FIG. 7, disposed in the image forming apparatus 1.

Figure 8:
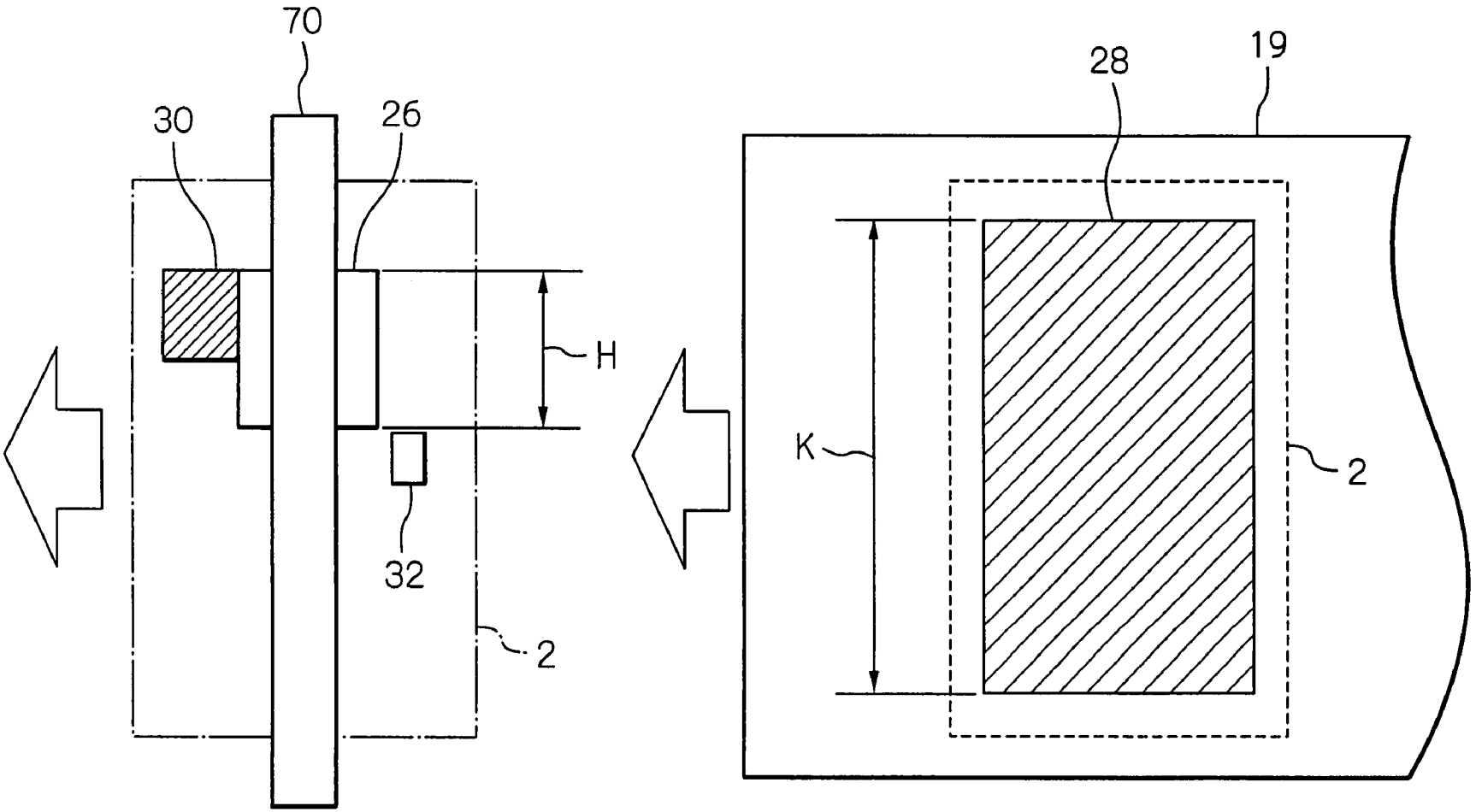
FIG. 8 is a view showing a print head included in the illustrative embodiment.

The print head 26 is capable of forming an image over the length H in the widthwise direction of the sheet, as stated earlier. On the other hand, as shown in FIG. 8, the stencil printer section 4 is capable of perforating the stencil 13, FIG. 1, over a length K in the widthwise direction of the sheet, which is usually 290 mm or so that copes with sheets of size A3. Should the length H be made as great as the length K, the print head 26 would be extremely expensive and would lack in reliability. In the illustrative embodiment, to make the print head 26 inexpensive, the length H is selected to be between about 60 mm and about 100 mm. Such a length H suffices because variable printing expected of the print head 26 is to form an address, serial number or similar partial data. In FIG. 8, there are shown a specific stencil image 28 formed on the sheet 2 and a specific ink jet image 30 also formed on the sheet 2.

Referring again to FIG. 1, the sheet stacking section 6 is positioned downstream of the ink jet printer section 5 in the direction of sheet conveyance. The sheet stacking section 6 includes a belt conveyor 34 and a print tray 35. The belt conveyor 34 conveys the sheet 2 being retained on a belt by a suction fan 33. The sheet 2 is then stacked on the print tray 35.

A conventional image reading device 40 is positioned above the stencil printer section 4 and includes a movable scanning unit 41 for reading a document 42 and a CCD (Charge Coupled Device) or similar image sensor 43 to which image data read by the scanning unit 41 are input.

Figure 3:
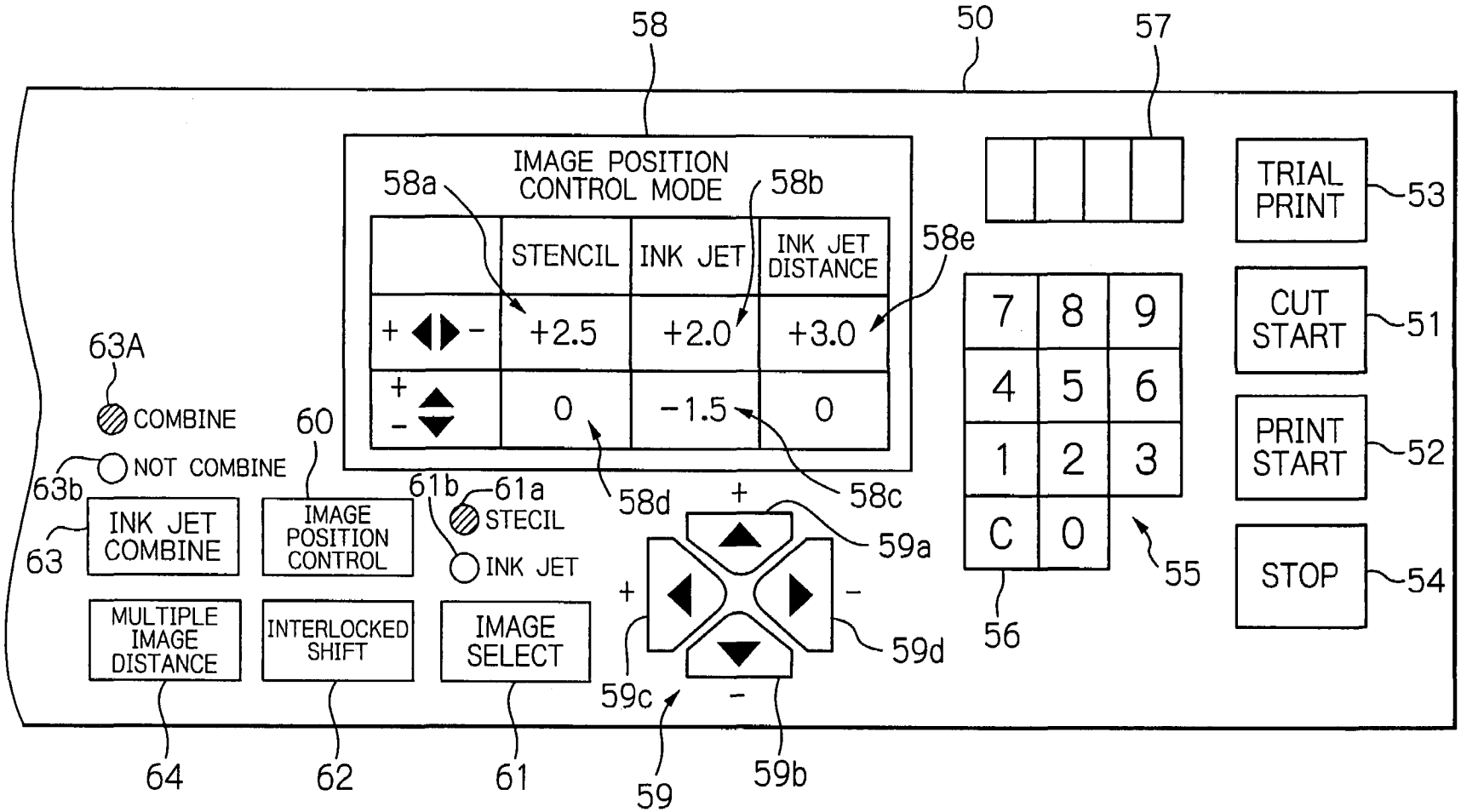
FIG. 3 is a view showing a specific arrangement of a control panel also included in the illustrative embodiment.

FIG. 3 shows a specific configuration of a control panel 50 mounted on the top front portion of the casing of the image forming apparatus 1. As shown, there are arranged on the control panel 50 a cut or master making start key 51, a print start key 52, a trial print key 53, a stop key 54, numeral keys 55, a clear key 56, an indicator 57 implemented by seven-segment LEDs (Light Emitting Diodes), a display 58 implemented by an LCD (Liquid Crystal Display) panel, direction keys 59, an image position control key 60, an image select key 61, an interlocked shift key 62, an inkjet combine key 63, a multiple image distance key 64 and so forth.

The indicator 57 selectively indicates various kinds of numerical values. The display 58, provided with a hierarchical structure, selectively displays various kinds of information. The direction keys 59 are made up of an "up" key 59*a*, a "down" key 59*b*, a "left" key 59*c* and a "right" key 59*d* to be used for setting various conditions. The image position control key 60 is pressed to operate the moving mechanism, not shown, and/or the moving mechanism 36 for shifting a stencil image and/or an ink jet image relative to the sheet 2. The image select key 61 is pressed to select either one of the stencil image and ink jet image to be shifted relative to the sheet 2; the stencil image and ink jet image replace with each other every time the key 61 is switched. LEDs 61*a* and 61*b* indicative of STENCIL IMAGE and INK JET IMAGE, respectively, are positioned adjacent to the image select key 61.

The interlocked shift key 62 is pressed when it is desired to shift both of a stencil image and an ink jet image by the same amount relative to the sheet 2 in interlocked relation to each other. The ink jet combine key 63 is pressed to form an ink jet image on the sheet 2 carrying a stencil image thereon. LEDs 63*a* and 63*b* indicative of COMBINE and NOT COMBINE, respectively, are arranged in the vicinity of the ink jet combine key 63. When an ink jet image is not to be combined, the sheet 2, carrying a stencil image thereon, is simply handed over from the roller pair 27, FIG. 1, to the roller pair 29, FIG. 1, with the print head 26, FIG. 1, being held inoperative. As for the multiple image distance key 64, when a plurality of ink jet images, each corresponding to a particular stencil image, should be formed, the key 64 is pressed to set a distance between nearby ink jet images.

Figure 7:
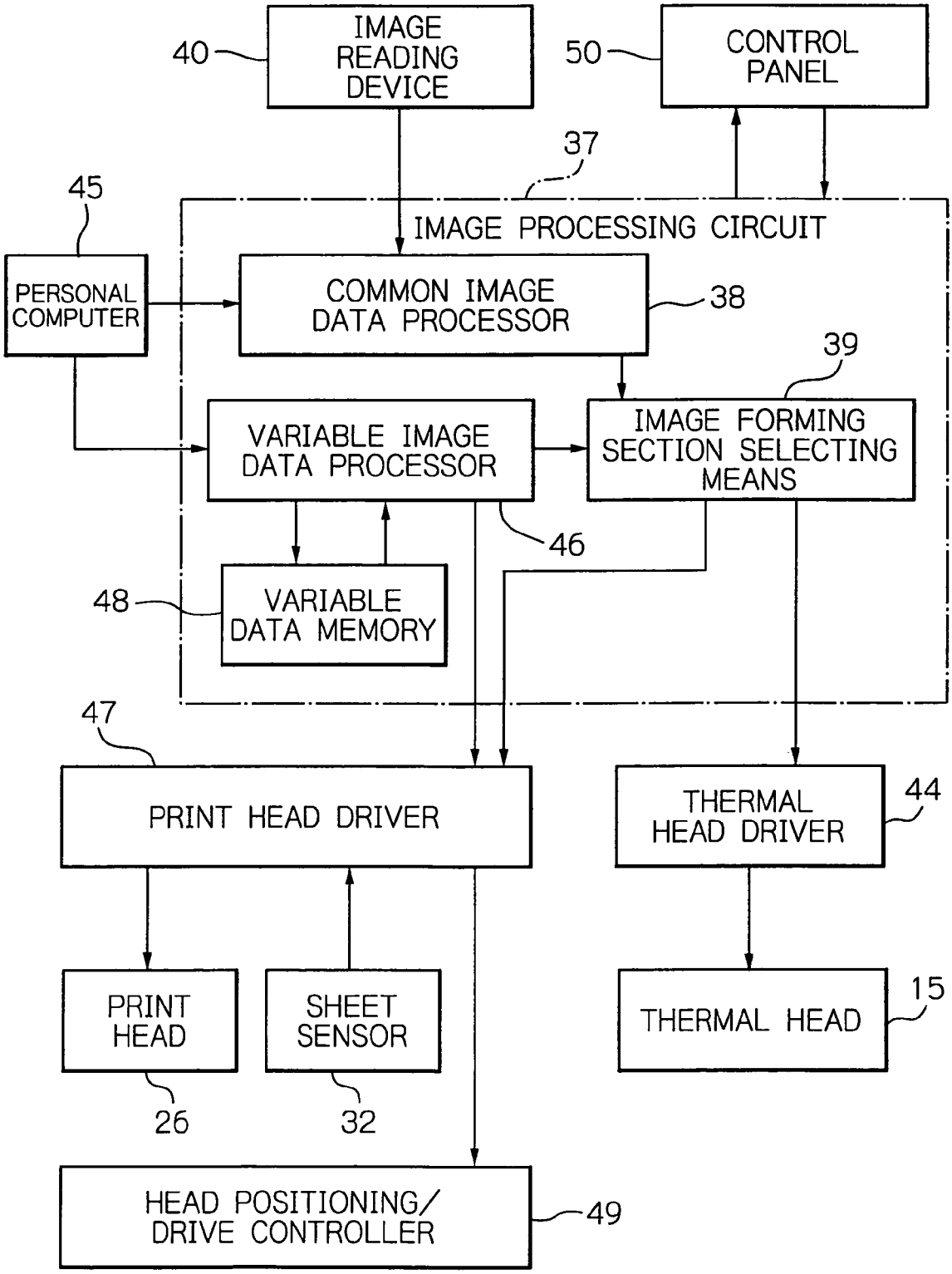
FIG. 7 is a schematic block diagram showing a control system included in the illustrative embodiment.

Reference will be made to FIG. 7 for describing a control system included in the image forming apparatus 1. As shown, the control system includes an image processing circuit 37 generally made up of a common image data processor 38, image forming section selecting means 39, a variable image data processor 46 and a variable data memory 48. The common image data processor 38 executes preselected image processing with common image data output from the image reading device 40. The common image data are then sent to a thermal head driver 44 via the image forming section selecting means 39. The thermal head driver 44 causes heating elements, not shown, included in the thermal head 15 to selectively generate heat in accordance with the input image data, thereby perforating or cutting the stencil 13.

On the other hand, variable image data output from the personal computer 45 are input to the variable image data processor 46 and subjected to preselected processing thereby. The variable image data are then delivered to a print head driver 47 via the image forming section selecting means 39. The print head driver 47 causes the print head 26 to selectively jet ink in accordance with the input image data, thereby forming an ink jet image. Alternatively, desired variable image data stored in the variable data memory 48 beforehand may be delivered to the print head driver 47 via the variable image data processor 46 and image forming section selecting means 39. A head positioning/drive controller 49 controls the operation of the print head 26 relative to the sheet 2 being conveyed.

A specific operation of the image forming apparatus 1 will be described hereinafter on the assumption that the operator of the apparatus 1 desires to print both a stencil image and an ink jet image on a single sheet 2. First, the operator presses the ink jet combine key 63 on the control panel 50. At this instant, the LED 63*a* indicative of COMBINE turns on. At the same time, the operator sets the document 42 on the image reading device 40 and then presses the cut start key 51.

When the cut start key 51 is pressed, the scanning unit 41 starts scanning the document 42 while sending the resulting image data to the image sensor 43. At the same time, a master discharging device, not shown, is operated to peel off the used master 19 from the print drum 20. Subsequently, the print drum 20 is rotated to a preselected stand-by position and stopped there. In this condition, a clamper, not shown, mounted on the circumferential surface of the print drum 20 is opened to wait for the master 19 produced from the stencil 13.

After the print drum 20 has been stopped at the stand-by position, the platen roller 16 and roller pair 18 are driven to pay out the stencil 13 from the stencil holder 14. When the stencil 13 thus paid out is brought to the thermal head 15, the thermal head 15 perforates, or cuts, the stencil 13 in accordance with the image data input to the image sensor 43. The perforated part of the stencil 13, i.e., the master 19 has its leading edge clamped by the damper of the print drum 20. Subsequently, the print drum 20 is rotated at a peripheral speed equal to the conveying speed of the stencil 13, so that the master 19 is wrapped around the print drum 20. As soon as the stencil 13 is conveyed by a distance corresponding to the size of a single master, the cutter 17 is actuated to cut the stencil 13.

After the above procedure, the operator presses the trial print key 53. In response, the pickup roller pair 11 pays out the top sheet 2 from the sheet tray 10 while separating it from the underlying sheets 2. The sheet 2 thus paid out is once stopped by the registration roller pair 12 and then conveyed thereby toward a gap between the print drum 20 and the press roller 22 at preselected timing. After the start of conveyance by the registration roller pair 12, the press roller 22 is brought into pressing contact with the master 19 wrapped around the print drum 20. As a result, a stencil image formed in the master 19 is transferred to the sheet 2. Subsequently, the sheet 2 is peeled off from the master 19 and then conveyed by the belt conveyor 25 to the further downstream side.

The sheet 2 thus conveyed by the belt conveyor 25 is further conveyed by the roller pair 27. When the sheet sensor 32 senses the leading edge of the sheet 2 in the direction of sheet conveyance, the personal computer 45, FIG. 7, or a data recording apparatus, not shown, sends data. The print head 26 operates in accordance with the above data to form an ink jet image on the sheet 2 carrying the stencil image thereon. The sheet 2, now carrying both of the stencil image and inkjet image, is conveyed by the roller pair 29 and then driven out to the print tray 35 by the belt conveyor 34 as a trial print.

Figure 4:
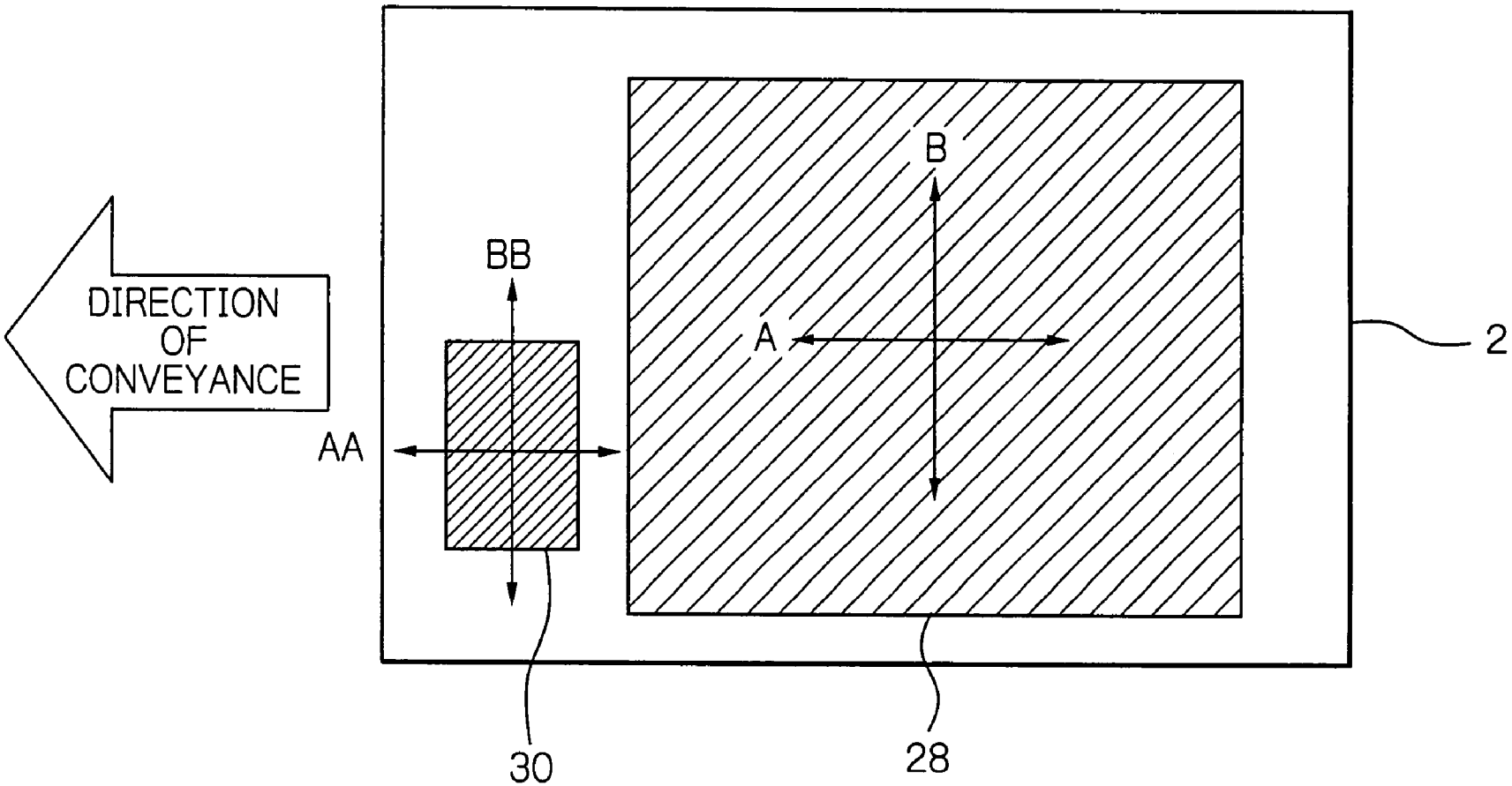
FIG. 4 shows a specific stencil image and a specific ink jet image formed on a single sheet by the illustrative embodiment.

As shown in FIG. 4, the stencil image 28 may be shifted in the direction of sheet conveyance indicated by a double-headed arrow A and/or the widthwise direction of the sheet 2 indicated by a double-headed arrow B. Likewise, the ink jet image 30 may be shifted in the direction of sheet conveyance indicated by a double-headed arrow AA and/or the widthwise direction of the sheet 2 indicated by a double-headed arrow BB. When the operator presses the image position control key 60 before shifting the images 28 and 30, a picture shown in FIG. 3 appears on the display 58.

Subsequently, the operator presses the image select key 61 in order to select the stencil image 28 or the ink jet image 30 that should be shifted. Every time the operator presses the key 61, the stencil image 28 and ink jet image 30 replace with each other while the LED 61*a* or 61*b* turns on accordingly. The operator then inputs a desired amount of shift in a desired direction on any one of the direction keys 59. As shown in FIG. 3, the amount of shift of the stencil image 28 and that of the ink jet image 30 appear on the display 58 side by side, and so do the amounts of shift in the direction of sheet conveyance and widthwise direction of the sheet. The operator is therefore capable of adjusting the position of the stencil image 28 and/or the position of the ink jet image 30 while watching the display 58.

For example, assume that the operator desires to shift the stencil image 28 by 2.5 mm to the downstream side in the direction of sheet conveyance. Then, the operator presses the image select key 61 while seeing the LED 61*a* turning on and then presses the "left" key 59*c*. In the illustrative embodiment, the amount of shift is added by 0.5 mm every time the operator presses any one of the direction keys 59*a* through 59*d*. Therefore, the operator, intending to shift the stencil image 28 by 2.5 mm, is expected to press the "left" key 59*c* five consecutive times. As a result, a numerical value "+2.5" appears in a frame 58*a* included in the display 58. In the example shown in FIG. 3, the stencil image 28 is not shifted in the widthwise direction of the sheet, so that a numerical value "0" in a frame 58*d* does not change.

Next, assuming that the operator desires to shift the ink jet image 30 by 2.0 mm to the downstream side in the direction of sheet conveyance. Then, the operator presses the image select key 61 while seeing the LED 61*b* turning on and then presses the "left" key 59*c* four consecutive times. In this case, a numerical value "+2.0" appears in a frame 58*b* included in the display 58. The operator may additionally shift the ink jet image 30 by 1.5 mm to the front side in the widthwise direction of the sheet by pressing the "down" key 59*b* three times, in which case a numerical value "−1.5" appears in a frame 58*c*.

In the illustrative embodiment, the image position control key 60, image select key 61 and direction keys 59*a* through 59*d* constitute a first and a second adjusting section. Also, the frames 58*a* and 58*d* and frames 58*b* and 58*c* of the display 58 play the role of a first and a second shift display section, respectively. Further, the direction keys 59 and image select key 61 serve as operating means and switching means, selectively.

As stated above, the illustrative embodiment allows the position of the stencil image 28 and that of the ink jet image 30 to be selected independently of each other relative to the sheet 2 and therefore allows the operator to easily arrange a desired image or images at desired positions. Thus, the illustrative embodiment promotes easy operation and free layout of images.

A modification of the illustrative embodiment will be described hereinafter. Assume that the operator desires to bodily shift the stencil image 28 and ink jet image 30 relative to the sheet 2 without varying the positional relation existing between the two images 28 and 30. Then, the operator presses the interlocked shift key 62 on the operation panel 50. On seeing the LEDs 61*a* and 61*b* turning on at the same time, indicating an interlocked shift mode, the operator inputs an amount of shift on any one of the direction keys 59*a* through 59*d* as in the illustrative embodiment. As a result, numerical values, existing in the frames 58*a* though 58*d* of the display 58, are increased or decreased by the same amount, causing the stencil image 28 and ink jet image 30 to be bodily shifted relative to the sheet 2 while being held in the same positional relation to each other. When the operator, selected the interlocked shift mode, again presses the interlocked shift key 62, the interlocked shift mode is canceled.

In the modification described above, the interlocked shift key 62, playing the role of interlocking means, allows the two images 28 and 30 to be bodily shifted relative to the sheet 2 while being held in the same positional relation to each other. The modification therefore further promotes easy operation.

Figure 5:
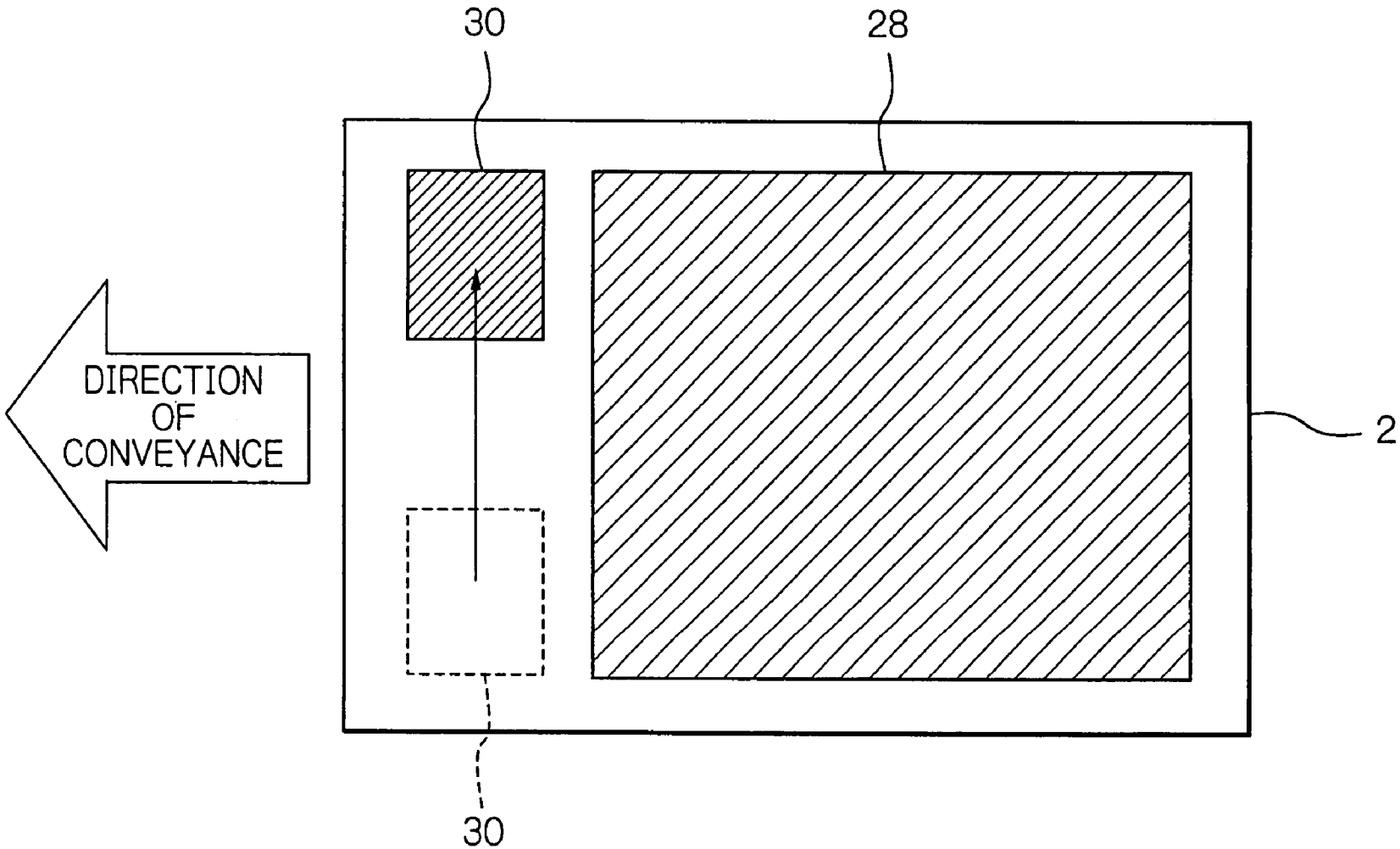
FIG. 5 is a view showing a modification of the illustrative embodiment.

Another modification of the illustrative embodiment will be described with reference to FIG. 5. The ink jet image 30 formed on the sheet 2 is usually smaller in area than the stencil image 28 and is sometimes desired to be shifted by a great amount. In such a case, if the amount of shift is increased by each 0.5 mm on any one of the direction keys 59*a* through 59*d* as in the illustrative embodiment, then the operation efficiency is noticeably lowered. In light of this, the modification allows the operator to directly input a desired amount of shift on the numeral keys 55.

More specifically, the operator presses the image select key 61 to select the ink jet image 30 as an image to shift while seeing the LED 61*b* turning on and then inputs, e.g., "110" on the numeral keys 55 as an amount of shift. The amount of shift "110" appears on the frame 58*c* of the display 58 as "+110". As a result, the ink jet image 30 to be printed on the sheet 2 is shifted from a position indicated by a phantom line in FIG. 5 to a position indicated by a solid line. In this modification, the numeral keys 55 serve as direct inputting means that allows the operator to directly input a desired amount of shift, as stated above. This further enhances easy operation.

Figure 6:
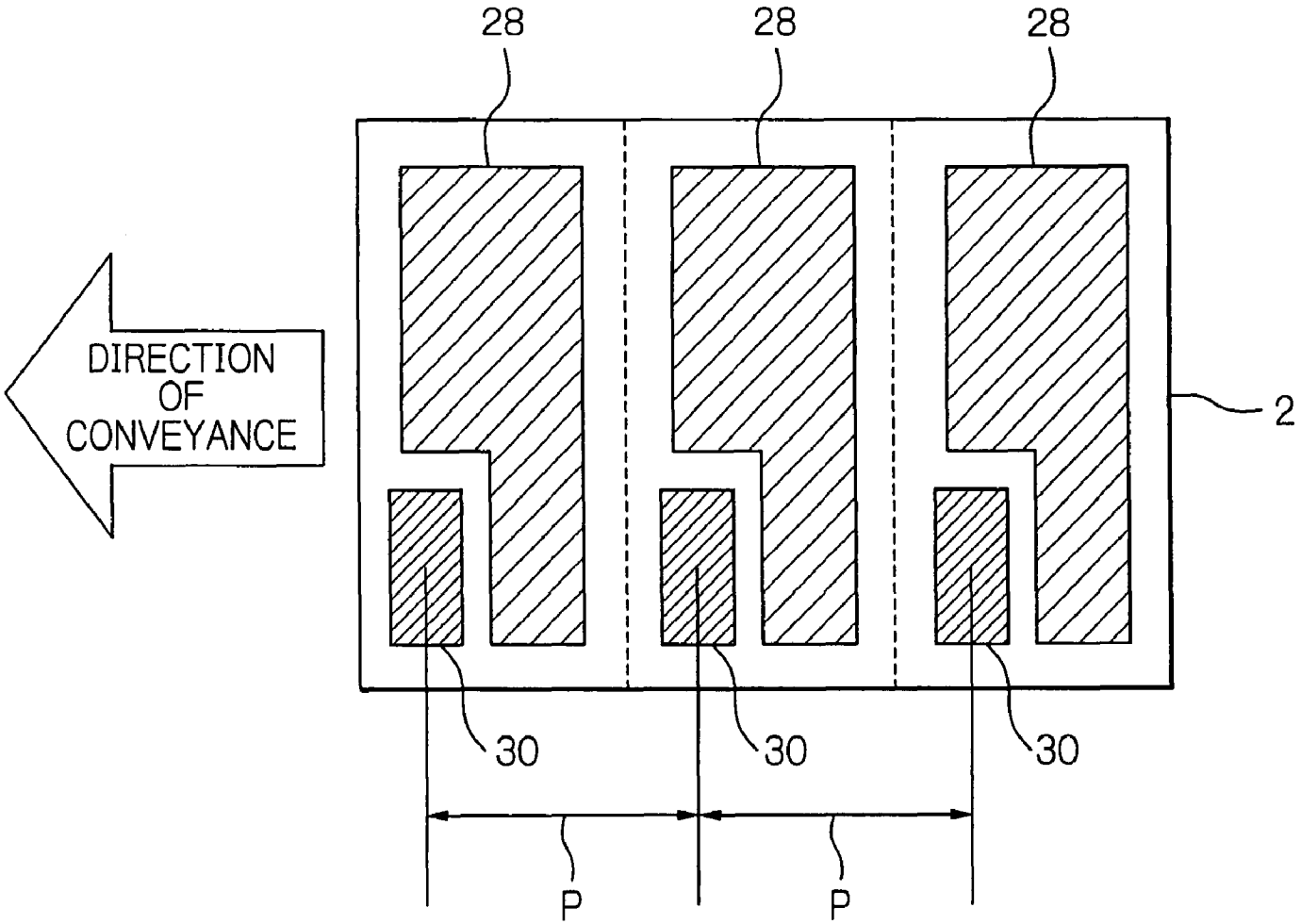
FIG. 6 is a view showing another modification of the illustrative embodiment.

FIG. 6 shows still another modification of the illustrative embodiment. As shown, three identical stencil images 28 are formed side by side on the sheet or print 2 in the direction of sheet conveyance. This kind of sheet 2 is customary with tickets or cards by way of example and cut away along dotted lines shown in FIG. 6 after image formation so as to be used as three separate prints. In this case, the ink jet images 30, each being associated with a particular stencil image 28, are serial numbers, reserve numbers or the like that should be different from each other.

In the modification shown in FIG. 6, the position of each stencil image 28 can be adjusted by the method stated earlier. However, it is likely that a distance P between nearby ink jet images 30 fails to match with the distance between nearby stencil images 28 and must therefore be adjusted. In such a case, the operator, watching the picture appearing on the display 58, presses the multiple picture distance key 64. As a result, a distance set mode is established. Assuming that the operator desires to increase the distance P by 3 mm, then the operator repeatedly presses the "left" key 59*c* six times, causing "+3.0" to appear in the frame 58*e* of the display 58. In this sense, the multiple picture distance key 64 serves as distance adjusting means. Thus, when the distance between nearby ink jet images 30 does not match with the distance between nearby stencil images 28, this modification allows the image position to be accurately adjusted and therefore insures desirable prints with a simple procedure.

In summary, it will be seen that the present invention provides an image forming apparatus allowing the position of a stencil image and that of a non-stencil image to be set independently of each other and therefore allowing desired images to be easily laid out at desired positions on a single sheet. This successfully enhances easy operation and free layout of images.

Various modifications will become possible for those skilled in the art after receiving the teachings of the present disclosure without departing from the scope thereof.

What is claimed is:

1. An image forming apparatus including a stencil printer section using a stencil and a non-stencil printer section not using a stencil and capable of forming a stencil image and a non-stencil image on a single sheet with said stencil printer section and said non-stencil printer section, respectively, said image forming apparatus comprising:

a first adjusting section for adjusting a position of the stencil image relative to the sheet in a direction of sheet conveyance and a widthwise direction of said sheet perpendicular to said direction of sheet conveyance;

a control panel having a display which includes a first shift display section for displaying an amount of shift of the position adjusted by said first adjusting section;

a second adjusting section for adjusting a position of the non-stencil image relative to the sheet in the direction of sheet conveyance and the widthwise direction of the sheet;

a second shift display section located in the control panel display for displaying an amount of shift of the position adjusted by said second adjusting section; and a moving mechanism for shifting the position of the non-stencil image in accordance with an operation of said second adjusting section by moving a print head in a direction perpendicular to a direction of sheet conveyance, wherein said first shift display section and said second shift display section are positioned side by side in said control panel for assisting adjustment of positioning of said stencil image with respect to said non-stencil image by an operator.

2. The apparatus as claimed in claim 1, wherein said first adjusting section and said second adjusting section share a single operating means, said apparatus further comprising switching means for switching said operating means to either one of said first adjusting section and said second adjusting section.

3. The apparatus as claimed in claim 1, further comprising distance adjusting means for adjusting, when said non-stencil image forming section forms a plurality of non-stencil images each being associated with a particular one of a plurality of stencil images formed on the sheet by said stencil printing section at equal intervals in the direction of sheet conveyance, a distance between said plurality of non-stencil images.

4. The apparatus as claimed in claim 2, further comprising interlocking means for causing, when the position of the stencil image is shifted by said first adjusting section, the position of the non-stencil image to be shifted in a same direction and by a same amount as said stencil image.

5. The apparatus as claimed in claim 4, further comprising direct inputting means for allowing the amount of shift of the non-stencil image to be directly input.

6. The apparatus as claimed in claim 5, further comprising distance adjusting means for adjusting, when said non-stencil image forming section forms a plurality of non-stencil images each being associated with a particular one of a plurality of stencil images formed on the sheet by said stencil printing section at equal intervals in the direction of sheet conveyance, a distance between said plurality of non-stencil images.

7. The apparatus as claimed in claim 1, further comprising direct inputting means for allowing the amount of shift of the non-stencil image to be directly input.

8. The apparatus as claimed in claim 1, further comprising interlocking means for causing, when the position of the stencil image is shifted by said first adjusting section, the position of the non-stencil image to be shifted in a same direction and by a same amount as said stencil image.

9. The apparatus as claimed in claim 8, further comprising direct inputting means for allowing the amount of shift of the non-stencil image to be directly input.

10. The apparatus as claimed in claim 9, further comprising distance adjusting means for adjusting, when said non-stencil image forming section forms a plurality of non-stencil images each being associated with a particular one of a plurality of stencil images formed on the sheet by said stencil printing section at equal intervals in the direction of sheet conveyance, a distance between said plurality of non-stencil images.

11. The apparatus as claimed in claim 1, further comprising interlocking means for causing, when the position of the stencil image is shifted by said first adjusting section, the position of the non-stencil image to be shifted in a same direction and by a same amount as said stencil image.

12. The apparatus as claimed in claim 11, further comprising direct inputting means for allowing the amount of shift of the non-stencil image to be directly input.

13. The apparatus as claimed in claim 5, further comprising distance adjusting means for adjusting, when said non-stencil image forming section forms a plurality of non-stencil images each being associated with a particular one of a plurality of stencil images formed on the sheet by said stencil printing section at equal intervals in the direction of sheet conveyance, a distance between said plurality of non-stencil images.

14. The apparatus as claimed in claim 7, further comprising distance adjusting means for adjusting, when said non-stencil image forming section forms a plurality of non-stencil images each being associated with a particular one of a plurality of stencil images formed on the sheet by said stencil printing section at equal intervals in the direction of sheet conveyance, a distance between said plurality of non-stencil images.

* * * * *